US010433661B2

(12) United States Patent
Hsu

(10) Patent No.: US 10,433,661 B2
(45) Date of Patent: Oct. 8, 2019

(54) PICTURE FRAME DEVICE

(71) Applicant: Yu-Wei Hsu, Taichung (TW)

(72) Inventor: Yu-Wei Hsu, Taichung (TW)

( * ) Notice: Subject to any disclaimer, the term of this patent is extended or adjusted under 35 U.S.C. 154(b) by 0 days.

(21) Appl. No.: 16/166,522

(22) Filed: Oct. 22, 2018

(65) Prior Publication Data

US 2019/0125107 A1 May 2, 2019

(30) Foreign Application Priority Data

Oct. 30, 2017 (TW) ..... 106216007 U

(51) Int. Cl.
*A47G 1/06* (2006.01)

(52) U.S. Cl.
CPC ..... *A47G 1/06* (2013.01); *A47G 1/0638* (2013.01); *A47G 2001/0677* (2013.01)

(58) Field of Classification Search
USPC ..... 40/771, 737, 795, 791, 794, 792, 740, 40/597
See application file for complete search history.

(56) References Cited

U.S. PATENT DOCUMENTS 3,093,356 A * 6/1963 Buyalos, Jr. ..... A63G 13/08 248/188.1
3,977,122 A * 8/1976 Meyer ..... A63H 13/12 446/268
4,014,119 A * 3/1977 Teufel ..... A47G 1/06 40/740
4,774,779 A * 10/1988 Ackeret ..... B42F 7/14 40/511
2002/0170216 A1* 11/2002 Pearce ..... A47G 1/02 40/597
2005/0279721 A1* 12/2005 Zoroufy ..... A47F 5/0006 211/45

* cited by examiner

*Primary Examiner* — Kristina N Junge
(74) *Attorney, Agent, or Firm* — Birch, Stewart, Kolasch & Birch, LLP

(57) ABSTRACT

A picture frame device includes a main frame unit and a first pressing unit. The main frame unit includes a frame body having a front plate, two connecting plates extending integrally and backward from two opposite sides of the front plate respectively, and two extending plates extending integrally and respectively from the connecting plates and toward each other. The front plate, the connecting plates and the extending plates cooperatively define an accommodating space. The frame body is made of a transparent plastic material. The first pressing unit includes a plurality of first fastening portions respectively disposed on the extending plates, and a plurality of first pressing portions respectively disposed on the first fastening portions in a way that each first pressing portion is moveably engaged with one of the first fastening portions and moveable toward or away from the front plate.

8 Claims, 18 Drawing Sheets

PICTURE FRAME DEVICE

BACKGROUND OF THE INVENTION

1. Field of the Invention

The present invention relates generally to an exhibition device and more particularly, to a picture frame device.

2. Description of the Related Art

As shown in FIG. 1, a conventional picture frame includes a front plate 1, a rear plate 2, and four threaded fasteners 3 disposed at four corners of the front and rear plates 1 and 2. The front and rear plates 1 and 2 are both acrylic plates. When the picture frame is in a state of use, the user places a picture 4 between the front and rear plates 1 and 2 and then tightens up the threaded fasteners 3 to clip the picture 4 between the front and rear plates 1 and 2. However, the picture 4 is actually unable to be firmly and tightly clipped between the front and rear plates 1 and 2, so the rear plate 2 is usually applied with a glue layer for enhancing fastening effect, thereby preventing the picture 4 from coming off. In this way, it is not only inconvenient in usage of the conventional picture frame, but also difficult for the user to replace the picture 4 from time to time. Besides, the front and rear plates 1 and 2 are thick and heavy, such that the conventional picture frame is uneasily fastened on the wall.

SUMMARY OF THE INVENTION

Therefore, it is an objective of the present invention to provide a picture frame device which can overcome at least one of the disadvantages of the conventional picture frame.

Thus, the picture frame device of the present invention includes a main frame unit, a first pressing unit and a pressing plate.

The main frame unit includes a frame body having a front plate, two connecting plates extending backwardly from two opposite sides of the front plate respectively, and two extending plates extending respectively from the connecting plates in a way that one of the extending plates extends downwardly and the other extends upwardly. The connecting plates are integrally connected with the front plate. The extending plates are integrally connected with the connecting plates respectively. The front plate, the connecting plates and the extending plates cooperatively define an accommodating space thereamong. The frame body is made of a transparent plastic material.

The first pressing unit includes a plurality of first fastening portions respectively disposed on the extending plates, and a plurality of first pressing portions respectively disposed on the first fastening portions in a way that each of the first pressing portions is moveably engaged with one of the first fastening portions and moveable toward or away from the front plate. The pressing plate is detachably disposed in the accommodating space of the frame body, and the first pressing portions face toward the pressing plate. Each first fastening portion comprises a first bolt fixedly disposed on one of the extending plates, and each first pressing portion comprises a first movable nut moveably and screwingly threaded onto the first bolt of one of the first fastening portions, and a suction pad disposed on the first movable nut for sucking and attaching the pressing plate.

The advantageous effect of the present invention lies in that the picture frame device is convenient for the user to replace the picture from time to time because the first pressing unit is configured in the way that the positions of the first pressing portions relative to the first fastening portions are adjustable frontward and backward. When the user adjusts the positions of the first pressing portions to move the first pressing portions frontward, the picture can be pressed on the front plate of the frame body firmly and tightly by the first pressing portions tightly pressing on the pressing plate. When the user adjusts the positions of the first pressing portions to move the first pressing portions backward, the picture can be released and replaced as the user's wish.

BRIEF DESCRIPTION OF THE DRAWINGS

The other features and effects of the present invention will be clearly presented in the detailed description of the present invention and the accompanying drawings, wherein.

DETAILED DESCRIPTION OF THE INVENTION

Figure 1:
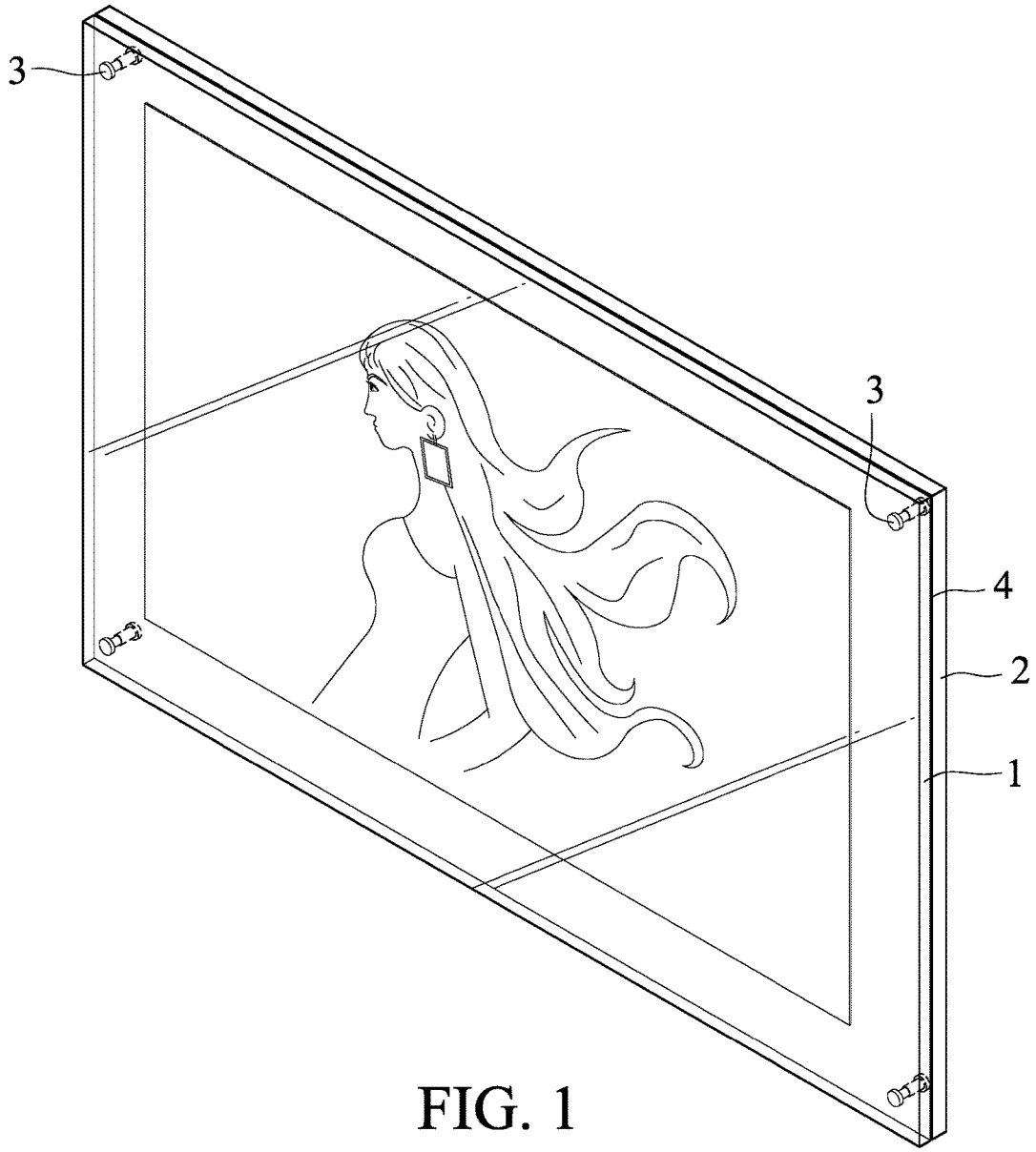
FIG. 1 Prior Art
FIG. 1 is a perspective view showing the appearance of a conventional picture frame.

Before the detailed description of the present invention is given, it should be noticed that in the following illustrative contents, similar elements are denoted by same reference numerals.

Figure 2:
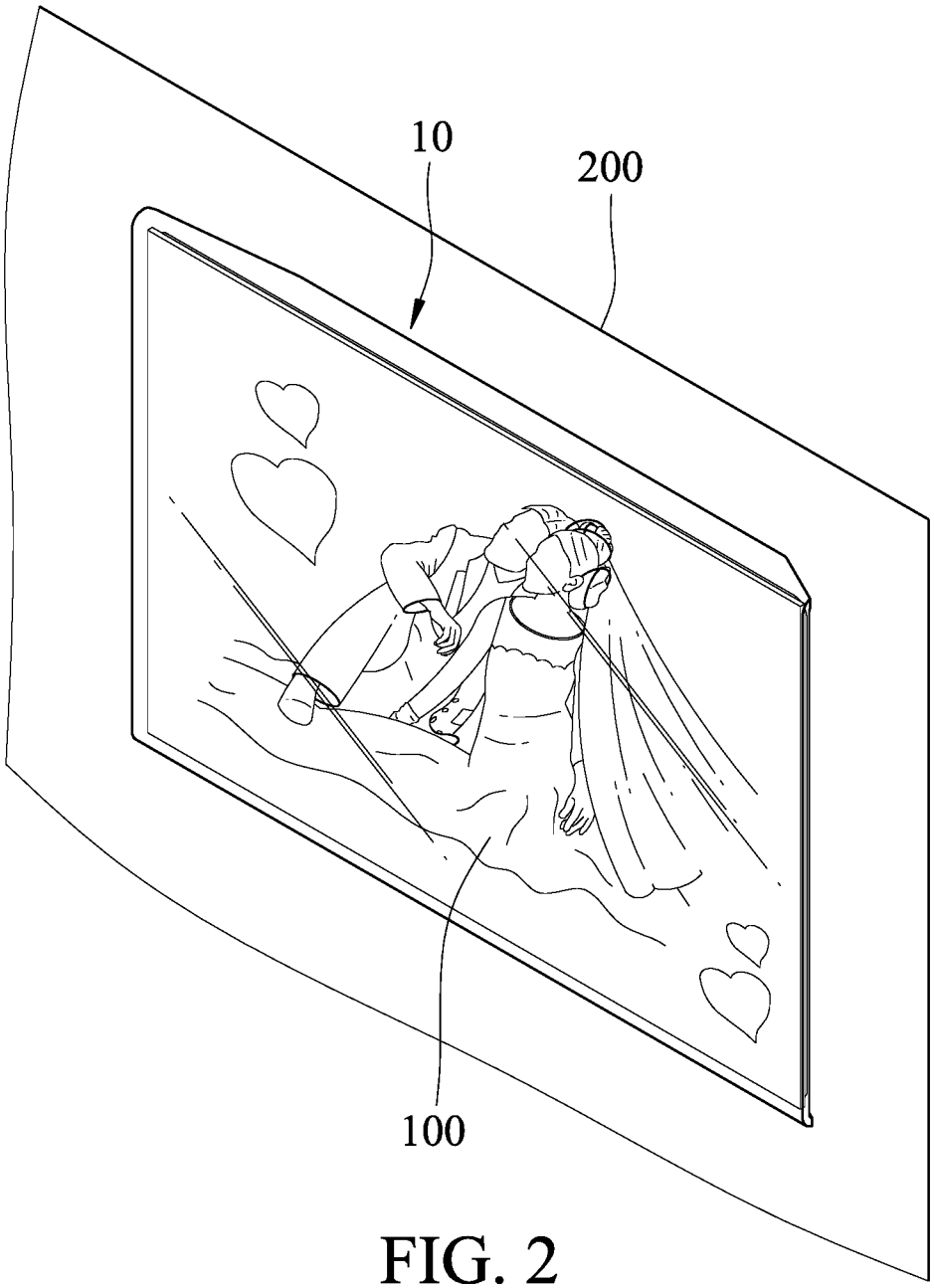
FIG. 2 is an assembled perspective view of a first embodiment of the picture frame device of the present invention, illustrating that the first embodiment is fastened on a wall.
Figure 3:
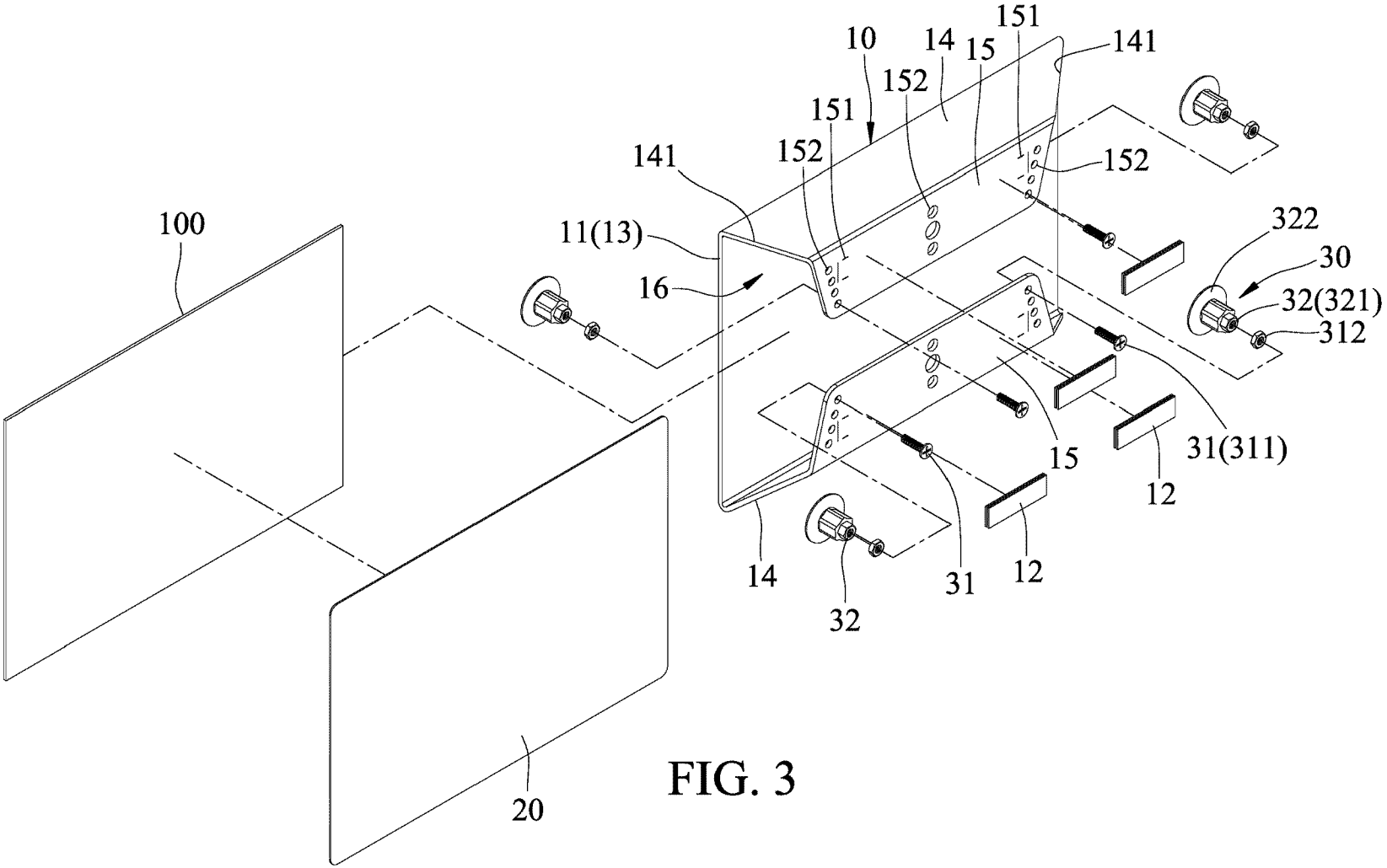
FIG. 3 is an exploded perspective view of the first embodiment and a picture.
Figure 4:
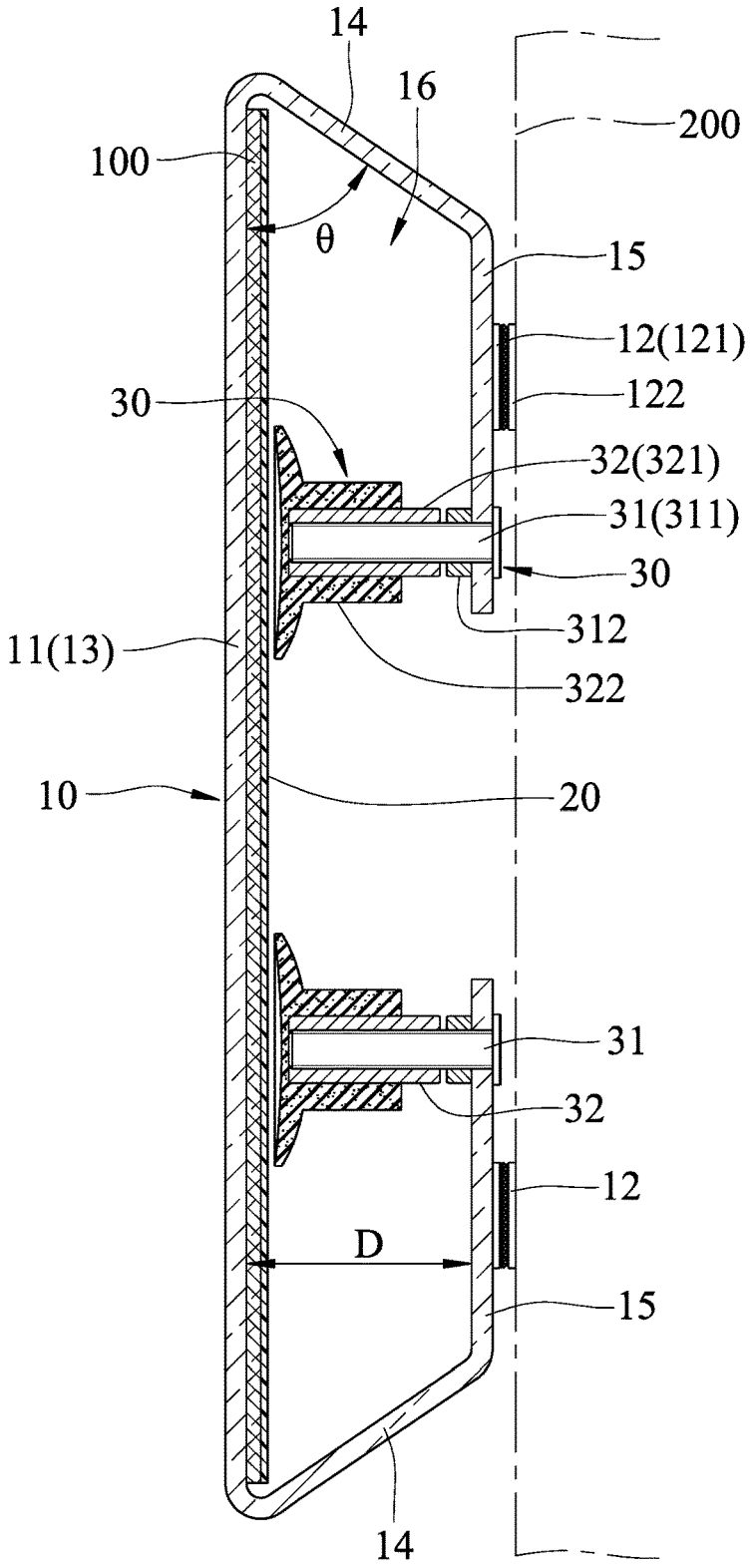
FIG. 4 is an assembled sectional view of the first embodiment and the picture, illustrating that the picture is not pressed tightly.

FIGS. 2, 3 and 4 illustrate a first embodiment of the picture frame device of the present invention, which is adapted for the exhibition of a picture 100. The picture frame device includes a main frame unit 10, a pressing plate 20, and a first pressing unit 30.

The main frame unit 10 includes a frame body 11, and four attachment combinations 12.

The frame body 11 has a front plate 13, two connecting plates 14 extending backwardly from two opposite sides of the front plate 13 respectively, and two extending plates 15 extending from the connecting plates 14 respectively in a way that one extending plate, namely the upper extending plate, extends downwardly and the other, namely the lower extending plate, extends upwardly. The connecting plates 14 are integrally connected with the front plate 13. The extending plates 15 are integrally connected with the connecting plates 14 respectively. The front plate 13, the connecting plates 14 and the extending plates 15 cooperatively define an accommodating space 16 thereamong. The frame body 11 is made of a transparent plastic material. In this first embodiment, the thickness of the frame body 11 is about 2 mm substantially, and the material of the frame body 11 may be acryl, PET (polyethylene terephthalate), PE (polyethylene), PVC (polyvinyl chloride), PS (polystyrene) or PC (polycarbonate). Preferably, the material of the frame body 11 is acryl.

In this first embodiment, each of the connecting plates 14 extends backward from the front plate 13 inclinedly. An acute angle θ is included between each of the connecting plates 14 and the front plate 13. Each of the connecting plates 14 has two connecting lateral edges 141 inclined toward each other and connected between the front plate 13 and the associated extending plate 15. The distances between the connecting lateral edges 141 of each connecting plate 14 decrease gradually from the front plate backwardly. The acute angle θ is about 45° substantially.

In this first embodiment, each of the extending plates 15 is provided on a backside surface thereof with two spacedly arranged aligning marks 151. Each extending plate 15 has a plurality of hanging holes 152 communicating with the accommodating space 16, and an interval D is formed between each of the extending plates 15 and the front plate 13 in a way that the interval D is sufficient to allow entry of a human finger.

The attachment combinations 12 are disposed on the associated extending plates 15. Each of the attachment combinations 12 is aligned with the associated aligning mark 151. In this first embodiment, each of the attachment combinations 12 has a first attachment member 121 adhering to the associated one of the extending plates 15, and a second attachment member 122 detachably engaged with the first attachment member 121. The second attachment member 122 is adapted for being fixedly adhered to a wall 200. Preferably, the attachment combination 12 may be the Dual Lock® produced by the 3M company.

The pressing plate 20 is detachably disposed in the accommodating space 16 of the frame body 11 and located behind the picture 100.

Figure 5:
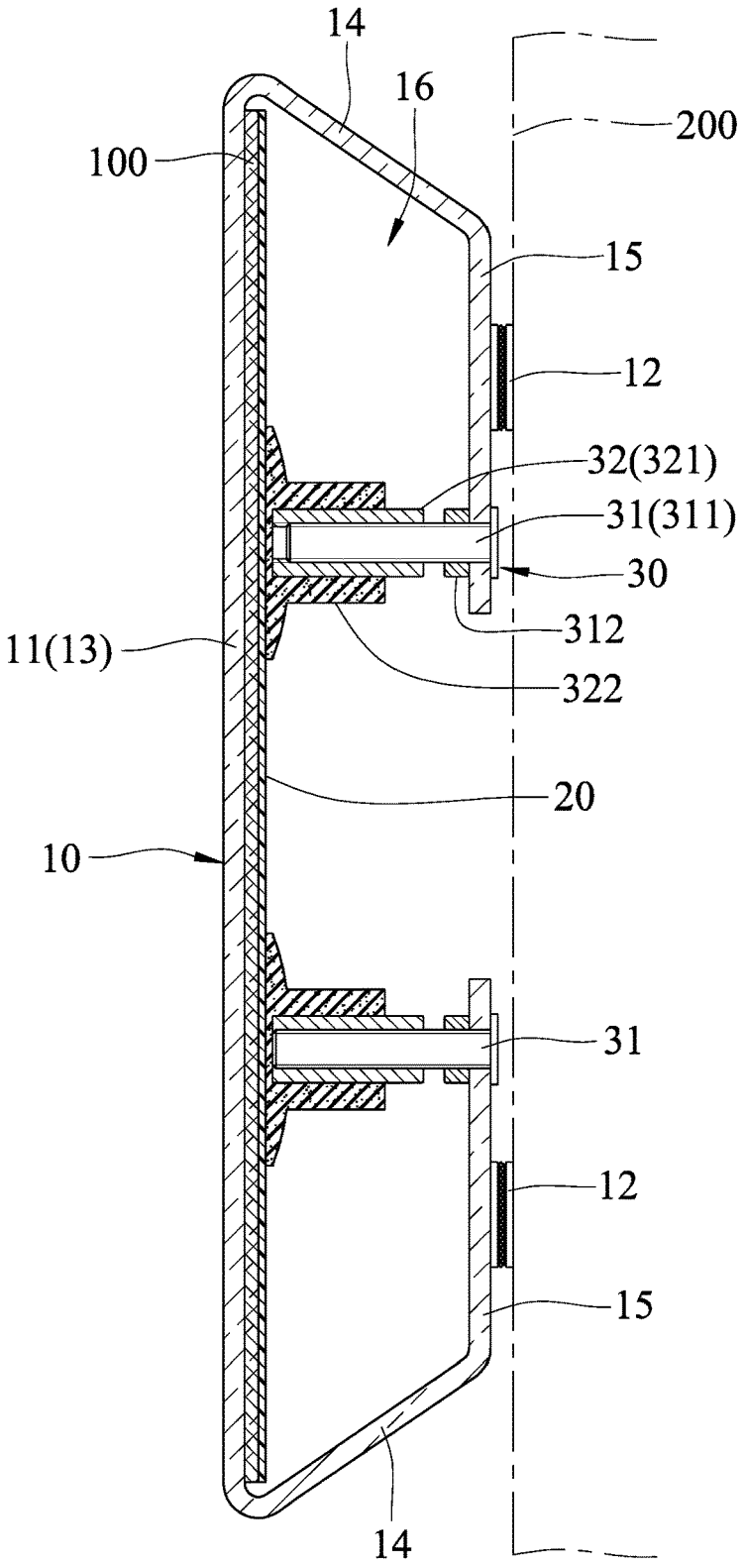
FIG. 5 is similar to FIG. 4, but illustrating that the picture is pressed tightly.
Figure 6:
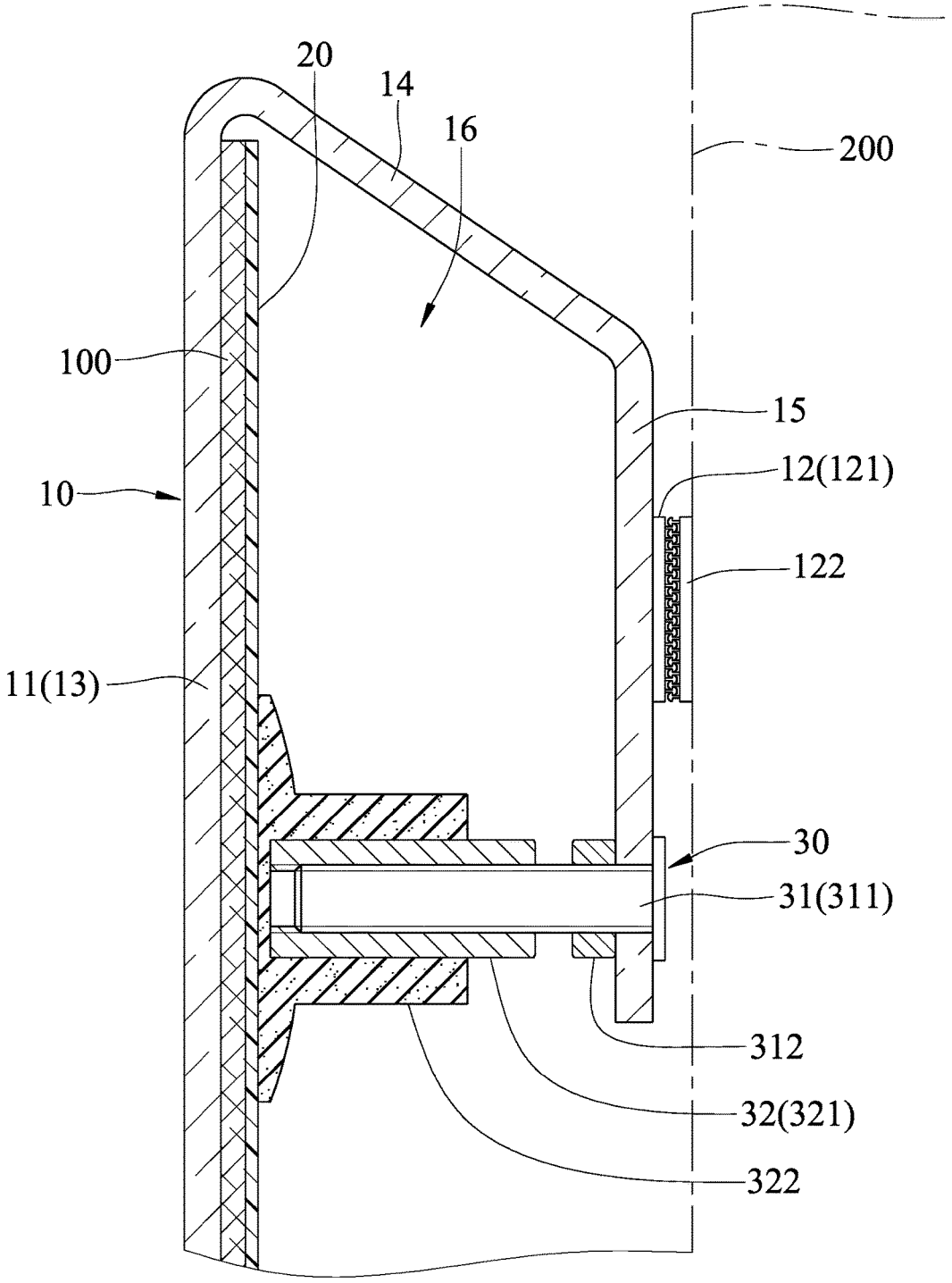
FIG. 6 is a partial enlarged view of FIG. 5.

As shown in FIGS. 4, 5 and 6, the first pressing unit 30 includes a plurality of first fastening portions 31 disposed on the associated extending plates 15, and a plurality of first pressing portions 32 disposed on the first fastening portions 31 respectively in a way that each first pressing portion 32 is moveably engaged with one of the first fastening portions 31 and movable toward or away from the front plate 13, such that the position of the first pressing portion 32 relative to associated first fastening portion 31 is adjustable to move frontward and backward and the first pressing portions 32 face toward the front plate 13.

In this first embodiment, each of the first fastening portions 31 has a first bolt 311 disposed on the associated one of the extending plates 15, and a first fastening nut 312 screwingly threaded onto the first bolt 311 to fasten the first bolt 311 to the associated one of the extending plates 15. Each of the first pressing portions 32 has a first movable nut 321 moveably and screwingly threaded onto the first bolt 311 of the associated first fastening portion 31, and a suction pad 322 disposed on the first movable nut 321 for sucking and attaching the pressing plate 20. Preferably, the first movable nut 321 is a hexagonal nut. It is to be mentioned that the first moveable nut 321 and the suction pad 322 may be configured as two individual members fixedly connected with each other by insert molding, embedding connection or threading connection. Alternatively, the first moveable nut 321 and the suction pad 322 may be integrally formed as one single member having a nut function and a suction function concurrently. Under this circumstance, the part of the single member having the nut function serves as the first moveable nut 321, and the part having the suction function serves as the suction pad 322. Further, the first bolt 311 may be directly fixed to the associated extending plate 15 by threading fastening, embedding fastening, or adhesion. Under this circumstance, the first fastening nut 312 may be omitted or serve as a supplementary fastening member.

As a result, as shown in FIGS. 5 and 6, when the user wants to use this first embodiment to exhibit a picture 100, at first the user can place the picture 100 and the pressing plate 20 together into the accommodating space 16 of the frame body 11. Thereafter, the user can use his/her fingers to turn and move the first pressing portions 32 frontward, causing the first pressing portions 32 to move frontward relative to the first bolts 311 of the first fastening portions 31 until the suction pads 322 are urged against the pressing plate 20 to suck and attach the pressing plate 20, so that the pressing plate 20 is pressed to cause the picture 100 clipped between the pressing plate 20 and the front plate 13 firmly and tightly. Reversely, as shown in FIG. 4, when the user wants to replace the picture 100, the user only needs to turn and move the first pressing portions 32 backward until the suction pads 322 are separated from the pressing plate 20, enabling the user to easily take the picture 100 and the pressing plate 20 out of the accommodating space 16 of the frame body 11 for replacing work.

It is to be mentioned that the user can exhibit the picture 100 by using the cooperative attachment between the first and second attachment members 121 and 122 of the attachment combinations 12 to fasten the frame body 11 and the picture 100 on the wall 200. Besides, it would be understandable that the user can alternatively hang the frame body 11 on the wall 200 by hooking the frame body 11 on hooks (not shown) mounted on the wall 200 through the hanging holes 152 of the extending plates 15, or hang the frame body 11 on the wall 200 through a string (not shown) penetrating through the hanging holes 152 of the extending plates 15.

According to the above illustration, the present invention has the following advantages.

First, the present invention uses the first pressing portions 32 of the first pressing unit 30 to press the pressing plate 20, which in turn tightly presses the picture 100. Compared with the conventional picture frame, the present invention is not only effective in clipping the picture 100 between the pressing plate 20 and the front plate 13 firmly and tightly, but also convenient for the user to replace the picture 100 from time to time according to demands.

Second, the suction pads 322 of the first pressing portions 32 of the first pressing unit 30 in the present invention can such and attach the pressing plate 20, thereby effectively preventing the pressing plate 20 and the picture 100 from slipping relative to the frame body 11.

Third, because the acute angle θ is included between the connecting plate 14 and the front plate 13, the connecting lateral edges 141 of the connecting plates 14 are connected between the front plate 13 and the associated extending plates 15 inclinedly, and the distances between the connecting lateral edges 141 of each connecting plate 14 decrease gradually from the front plate backwardly, the present invention is effective in preventing the connecting plates 14 and the extending plates 15 from being seen by the viewers when the picture frame device is viewed from a front side thereof, thereby enhancing exhibiting effect of the picture 100.

Fourth, the frame body 11 in the present invention is formed integrally as one single piece and has a thin thickness, so the total weight is relatively light. Compared with the conventional picture frame, the frame body 11 is easier to be fastened on the wall 200 and can be fastened to the wall by various ways for the users.

It is to be mentioned that this first embodiment may have no such pressing plate 20, but use the first pressing portions 32 of the first pressing unit 30 to directly press the picture 100 on the front plate 13 tightly.

Figure 7:
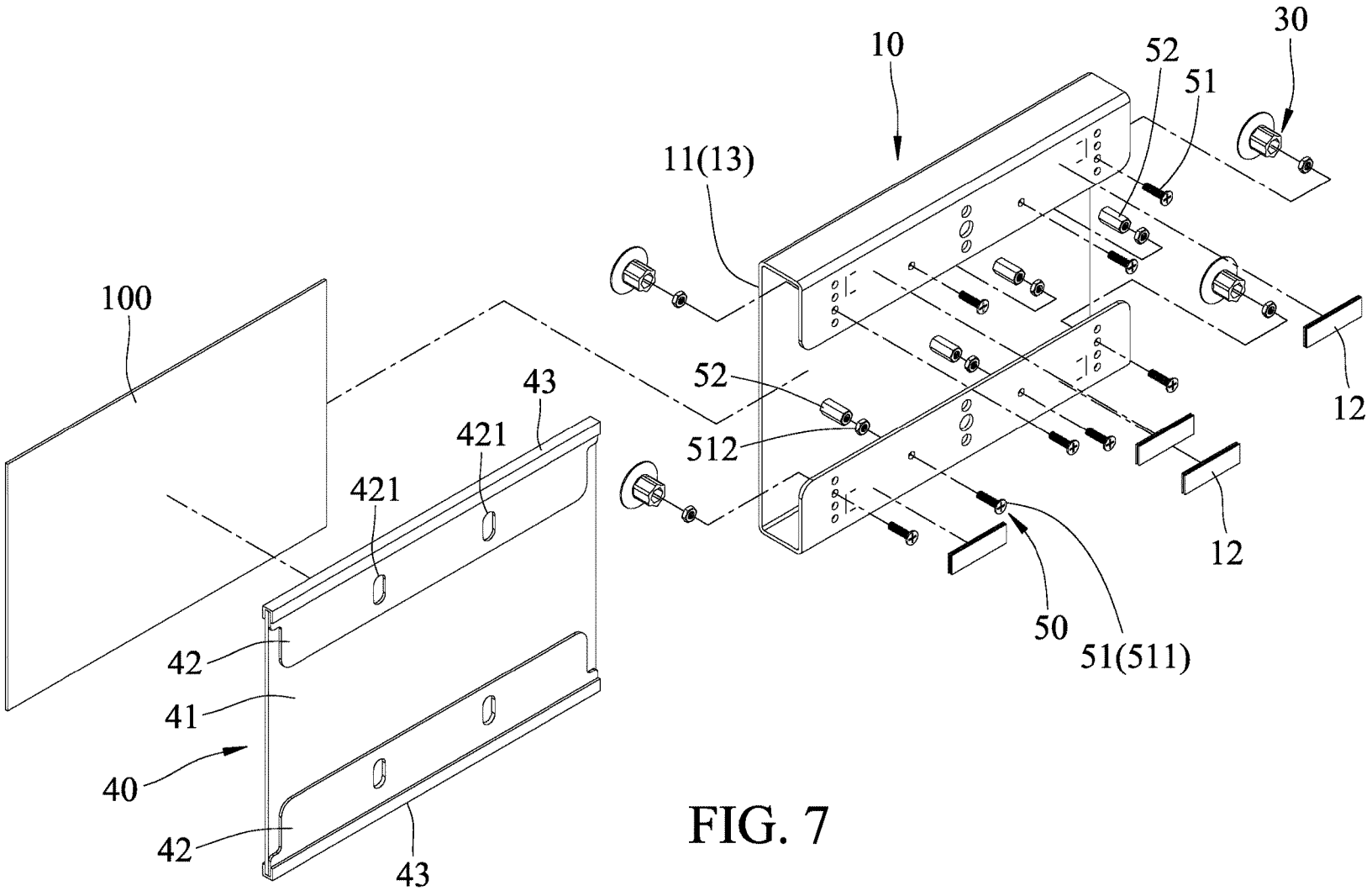
FIG. 7 is an exploded perspective view of a second embodiment of the picture frame device of the present invention and a picture.
Figure 8:
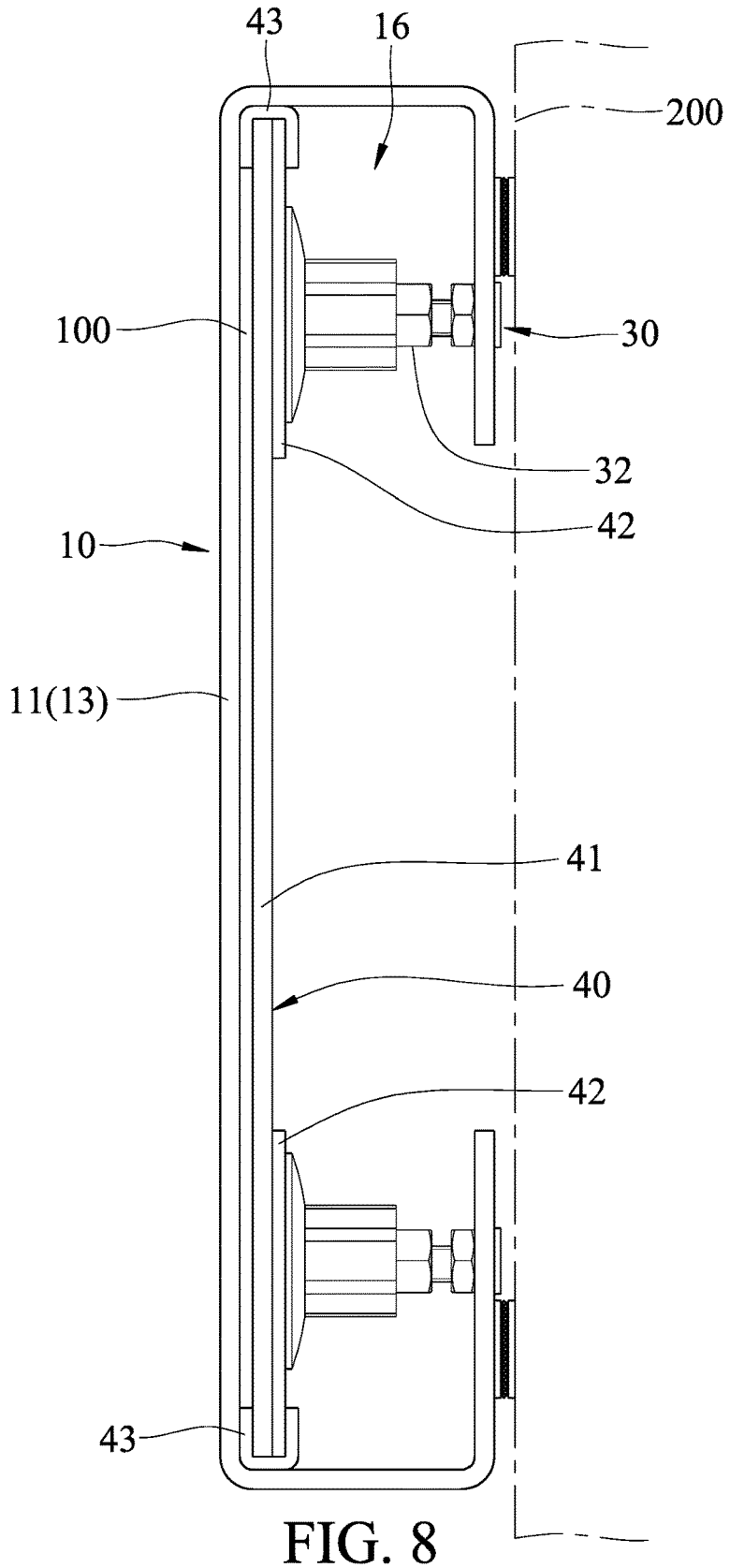
FIG. 8 is an assembled lateral view of the second embodiment and the picture.

FIGS. 7 and 8 illustrate a second embodiment of the present invention, which is similar to the first embodiment, but the second embodiment and the first embodiment have the following difference therebetween.

The pressing plate of the second embodiment is a light guiding unit 40 detachably disposed in the accommodating space 16 of the frame body 11, and the second embodiment further includes a second pressing unit 50. In other words, the pressing plate provided by the present invention is not limited to a single piece as being disclosed by the first embodiment. The pressing plate may be configured as a member having a specific function, such as the light guiding unit 40 as disclosed in this embodiment.

The light guiding unit 40 has a light guiding panel 41, two installation boards 42 disposed on a backside surface of the light guiding panel 41 and located adjacent to two opposite sides of the light guiding panel 41 respectively, and two combining frame strips 43 clipping the installation boards 42 and the light guiding panel 41 together. Each of the installation boards 42 has a plurality of limiting grooves 421 penetrating therethrough.

Figure 9:
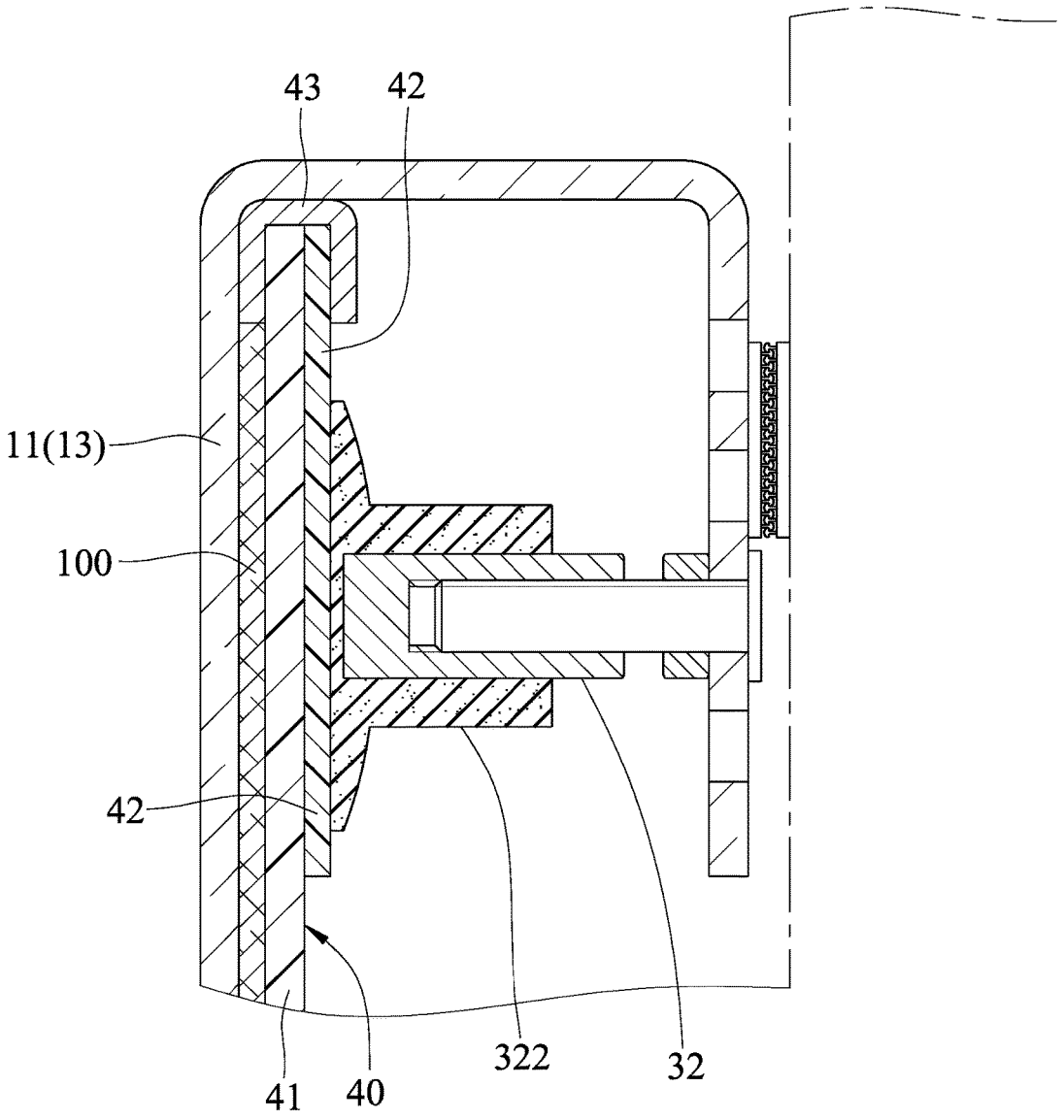
FIG. 9 is a partial assembled sectional view of the second embodiment and the picture, illustrating that a first pressing portion of a first pressing unit of the second embodiment frontward presses the picture tightly.

As shown in FIG. 9, the first pressing portions 32 of the first pressing unit 30 face toward the associated installation boards 42.

Figure 10:
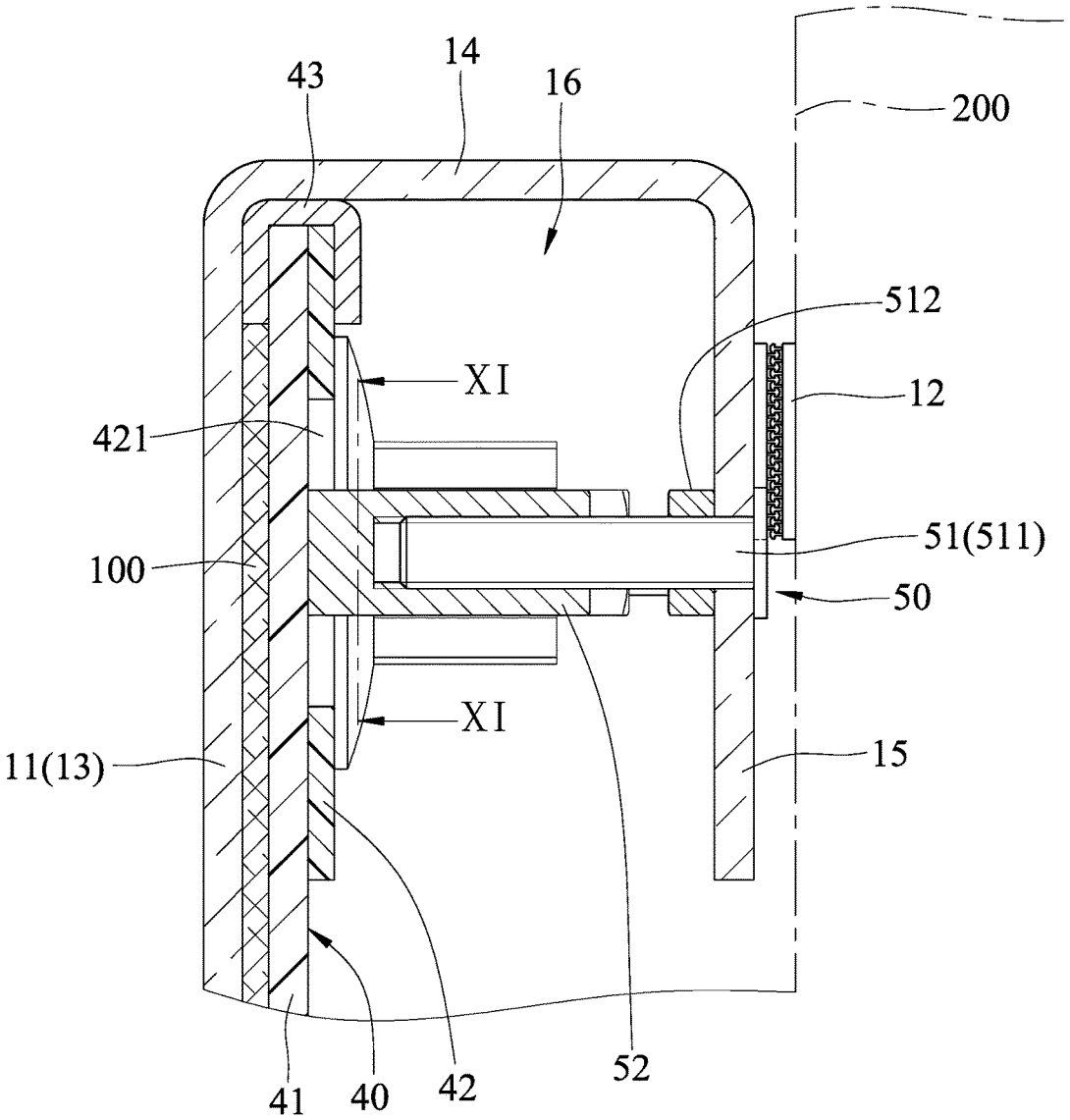
FIG. 10 is similar to FIG. 9, but illustrating that a second pressing portion of a second pressing unit of the second embodiment frontward presses the picture tightly.
Figure 11:
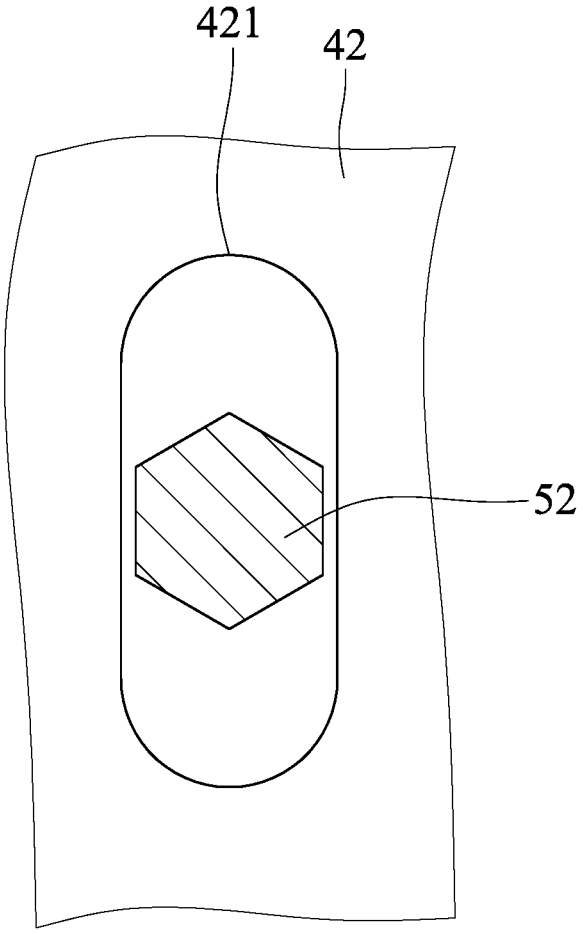
FIG. 11 is a partial sectional view taken along the line XI-XI in FIG. 10.

As shown in FIGS. 7, 10 and 11, the second pressing unit 50 includes a plurality of second fastening portions 51 disposed on the associated extending plates 15, and a plurality of second pressing portions 52 disposed on the second fastening portions 51 respectively in a way that each second pressing portion 52 is moveably engaged with one of the second fastening portions 51 and moveable toward or away from one of the installation boards 42, such that the positions of the second pressing portions 52 relative to the second fastening portions 51 are adjustable to move frontward and backward and the second pressing portions 52 face toward the associated installation boards 42.

Each of the second fastening portions 51 has a second bolt 511 disposed on associated one of the extending plates 15, and a second fastening nut 512 screwingly threaded onto the second bolt 511 to fasten the second bolt 511 to the associated one of the extending plates 15. In other embodiment, the second bolt 511 is directly fastened to the extending plate 15 by threading fastening, embedding fastening or adhesion without the second fastening nut 512. Each of the second pressing portions 52 is moveably and screwingly threaded onto the second bolt 511 of the associated second fastening portion 51. Each of the second pressing portions 52 faces toward the associated limiting groove 421. In this second embodiment, the second pressing portion 52 is a hexagonal nut.

As a result, as shown in FIGS. 9, 10 and 11, the user can use his/her fingers to turn and move the first and second pressing portions 32 and 52 frontward, causing the first pressing portions 32 to move frontward until the suction pads 322 are urged against the pressing plate 20 to suck and attach the pressing plate 20 and causing the second pressing portions 52 to move frontward until the front ends thereof are inserted into the associated limiting grooves 421 to urge against the light guiding panel 41, so that the light guiding panel 41 is pressed to cause the picture 100 clipped between the light guiding panel 41 and the front plate 13 firmly and tightly. In this way, the first and second pressing portions 32 and 52 are used to press the light guiding panel 41 to fasten the picture 100. Besides, when the picture 100 is changed from the transverse exhibiting posture to the vertical exhibiting posture, the cooperative embedding and engagement between the second pressing portions 52 and the limiting grooves 421 of the installation boards 42 limit the position of the light guiding unit 40, thereby preventing the light guiding unit 40 and the picture 100 from slipping downward relative to the frame body 11. Furthermore, this second embodiment can use the light guiding panel 41 to guide the light of a light source, such as an LED lamp (not shown), to the picture 100, thereby generating relatively greater exhibiting effect.

Therefore, this second embodiment can attain the same objectives and effects that the above-mentioned first embodiment can.

Figure 12:
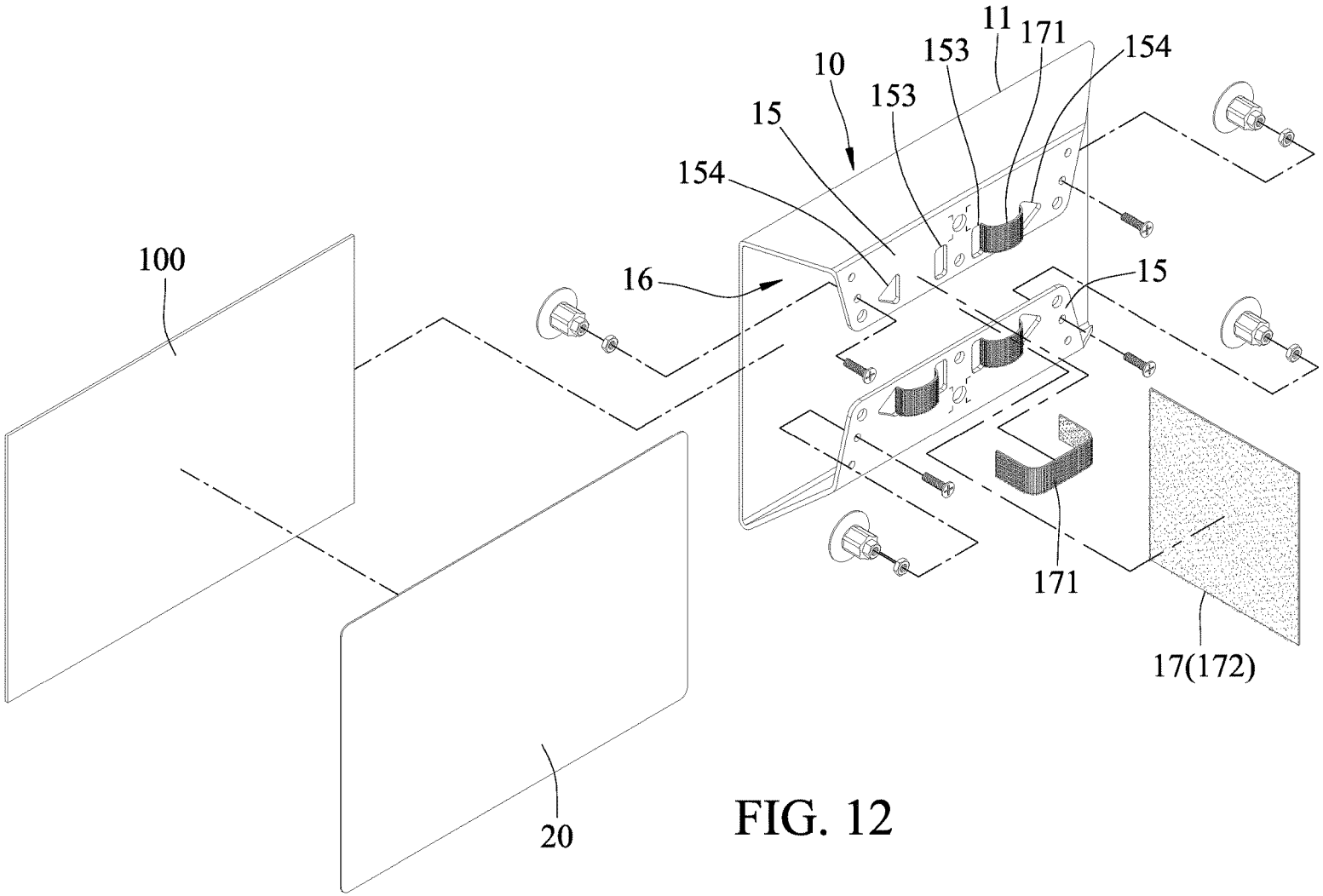
FIG. 12 is an exploded perspective view of a third embodiment of the picture frame device of the present invention and a picture.
Figure 13:
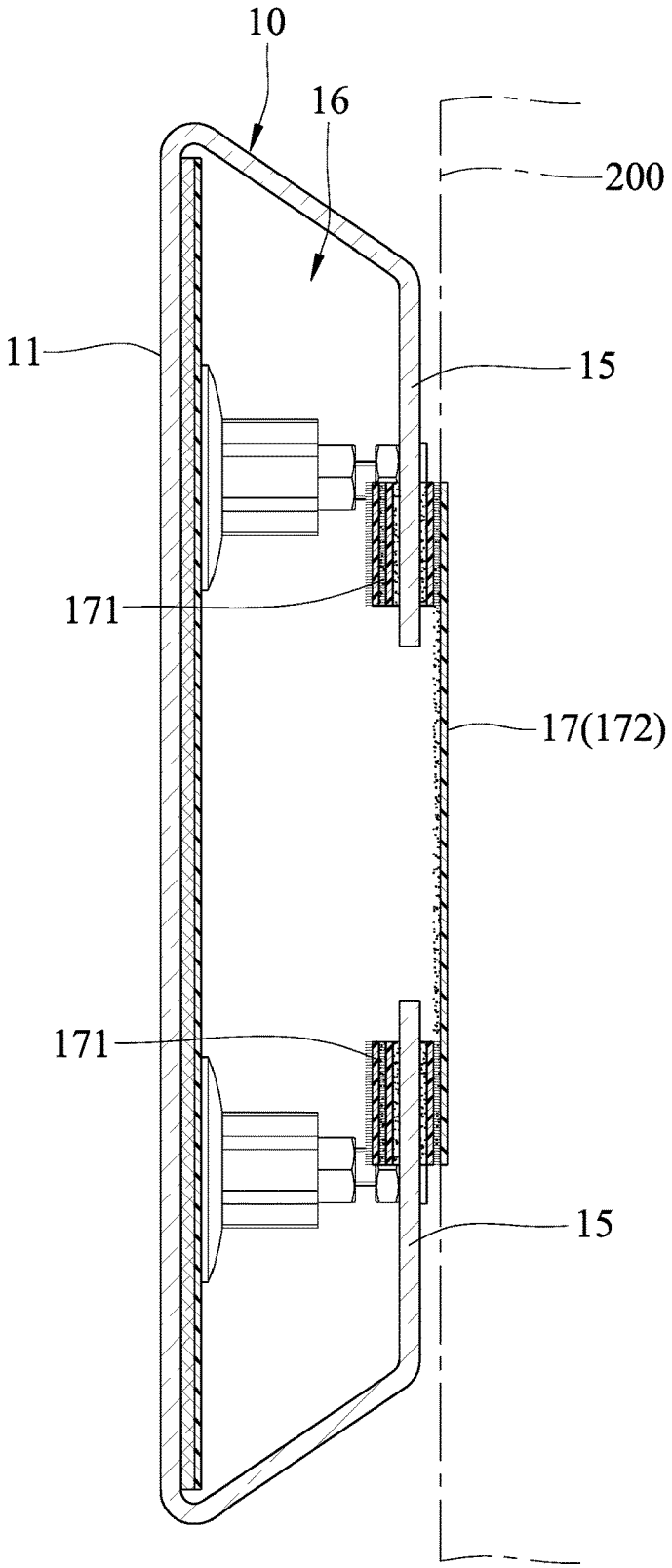
FIG. 13 is an assembled sectional view of the third embodiment and the picture.

FIGS. 12 and 13 illustrate a third embodiment of the present invention, which is similar to the first embodiment, but the third embodiment and the first embodiment have the following difference therebetween.

Each of the extending plates 15 of the frame body 11 further has two sectionally rectangle-shaped hanging holes 153 communicating with the accommodating space 16, and two sectionally triangle-shaped hanging holes 154 communicating with the accommodating space 16.

The main frame unit 10 includes an attachment combination 17 which has four first attachment members 171 disposed on the associated extending plates 15, and a second attachment member 172 shared by the first attachment members 171. In this embodiment, the attachment combination 17 is a kind of Velcro®, i.e. loop and hook fastener. Each first attachment member 171 has inner and outer surfaces provided with loops and hooks respectively. Each first attachment member 171 is disposed to associated extending plate 15 in a way that the first attachment member 171 is penetrated through adjacent hanging holes 153 and 154 of the associated extending plate 15 with the hook and the loops engaged together. The second attachment member 172 is adapted for being fixedly adhered to the wall 200. The second attachment member 172 is provided at the outer surface thereof with loops. The first attachment members 171 are commonly and detachably engaged with the second attachment member 172 by a loop and hook fastening so as to fasten the frame body 11 on the wall 200 firmly. It should be noticed that the amount of the second attachment member 172 is not limited to one as being disclosed in this embodiment. In other instanced variations of this embodiment, two or four second attachment members 172 may be used. In the condition that two second attachment members 172 are used, every two first attachment members 171 are commonly engaged and fastened with an associated second attachment member 172 by loop and hook fastening. In the condition that four second attachment members 172 are used, each first attachment member 171 is engaged and fastened with one associated second attachment member 172.

Therefore, this third embodiment can attain the same objectives and effects that the above-mentioned first embodiment can.

Figure 14:
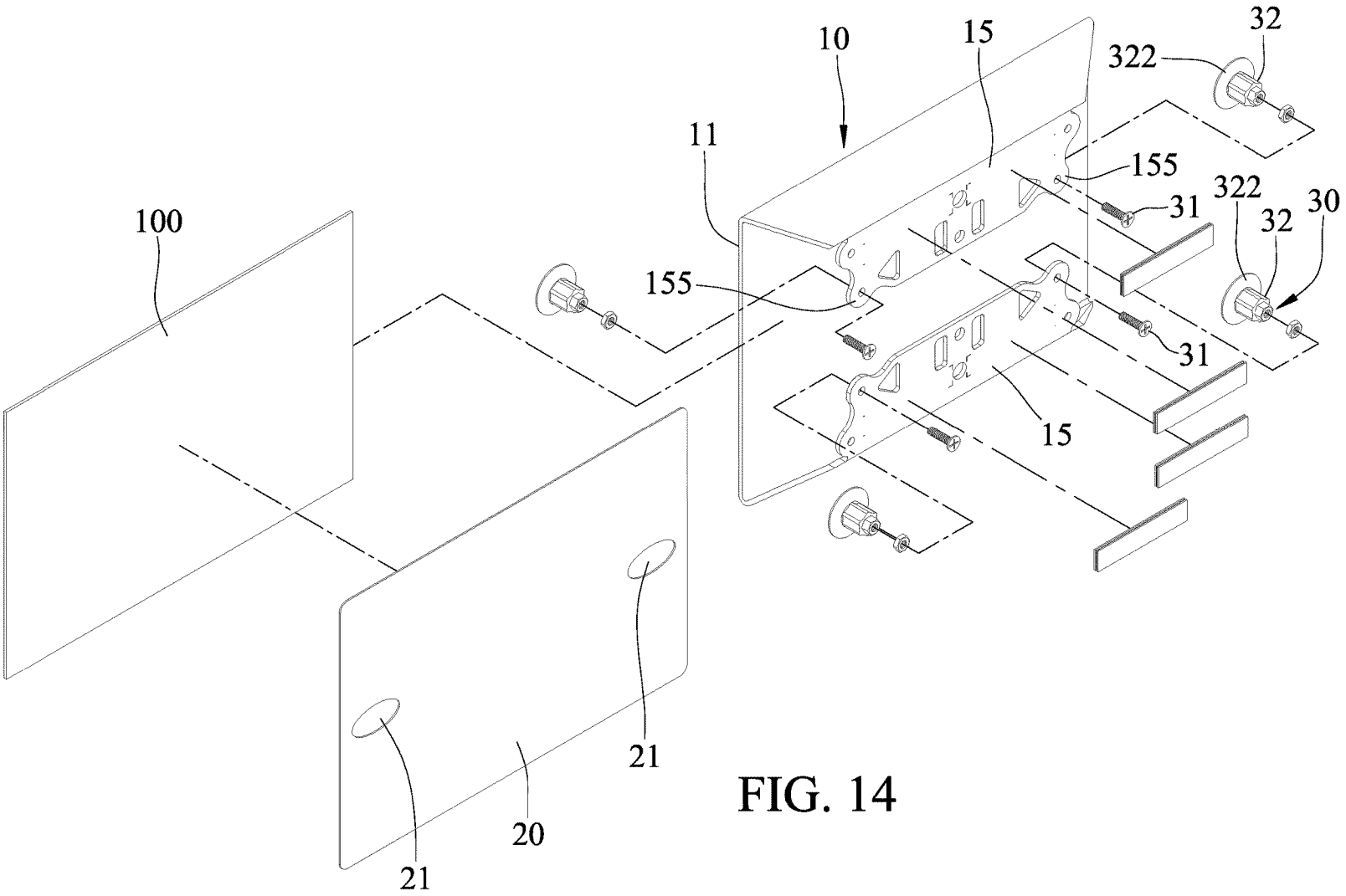
FIG. 14 is an exploded perspective view of a fourth embodiment of the picture frame device of the present invention and a picture.
Figure 15:
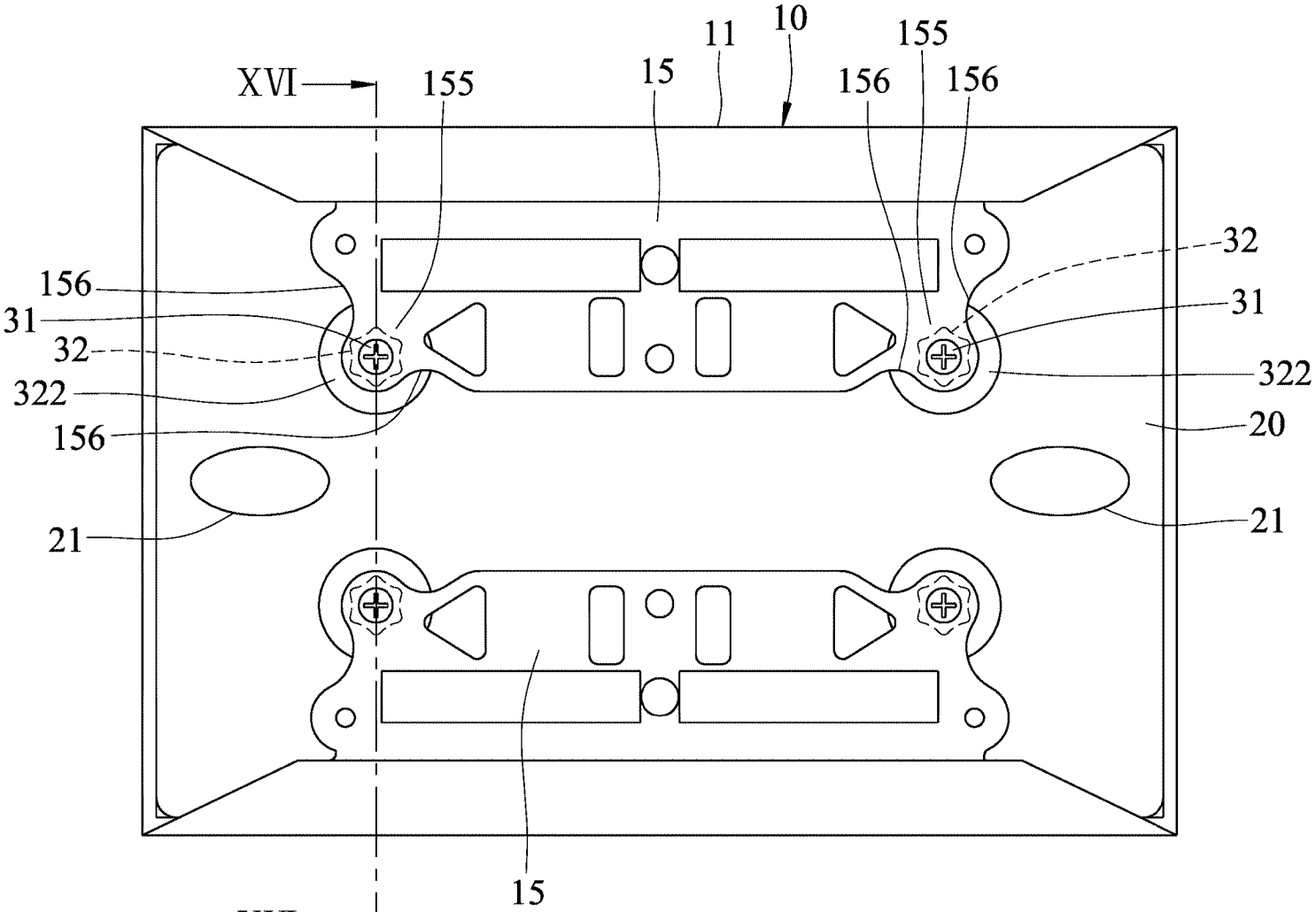
FIG. 15 is a rear view of the fourth embodiment.

FIGS. 14 and 15 illustrate a fourth embodiment of the present invention, which is similar to the first embodiment, but the fourth embodiment and the first embodiment have the following difference therebetween.

Each of the extending plates 15 of the frame body 11 has two side corner portions 155 separated from each other. The outer peripheral surface of each of the side corner portions 155 is formed with two finger locating recesses 156 directing toward each other.

The pressing plate 20 is formed adjacent to the left and right sides thereof with two taking-out through holes 21 separated from each other.

The first fastening portions 31 of the first pressing unit 30 are disposed on the side corner portions 155 of the extending plates 15 respectively. Each of the first fastening portions 31 is located between the finger locating recesses 156 of the associated side corner portion 155.

As a result, when the user wants to turn and move the first pressing portions 32 frontward or backward, portions of the thumb and the forefinger can be abutted into the finger locating recesses 156 of one of the side corner portions 155. The finger locating recesses 156 can lower the obstruction caused to the fingers by the side corner portions 155. This design is relatively more convenient for the thumb and the forefinger of the user to turn and move the first pressing portions 32.

Besides, in the condition that the user wants to replace the picture 100 and therefore turns and moves the first pressing portions 32 backward, after the suction pads 322 are separated from the pressing plate 20, the user can reach his/her fingers into the taking-out through holes 21 of the pressing plate 20 to push out the picture 100 relative to the pressing plate 20 from one side thereof for replacing the picture 100.

Figure 16:
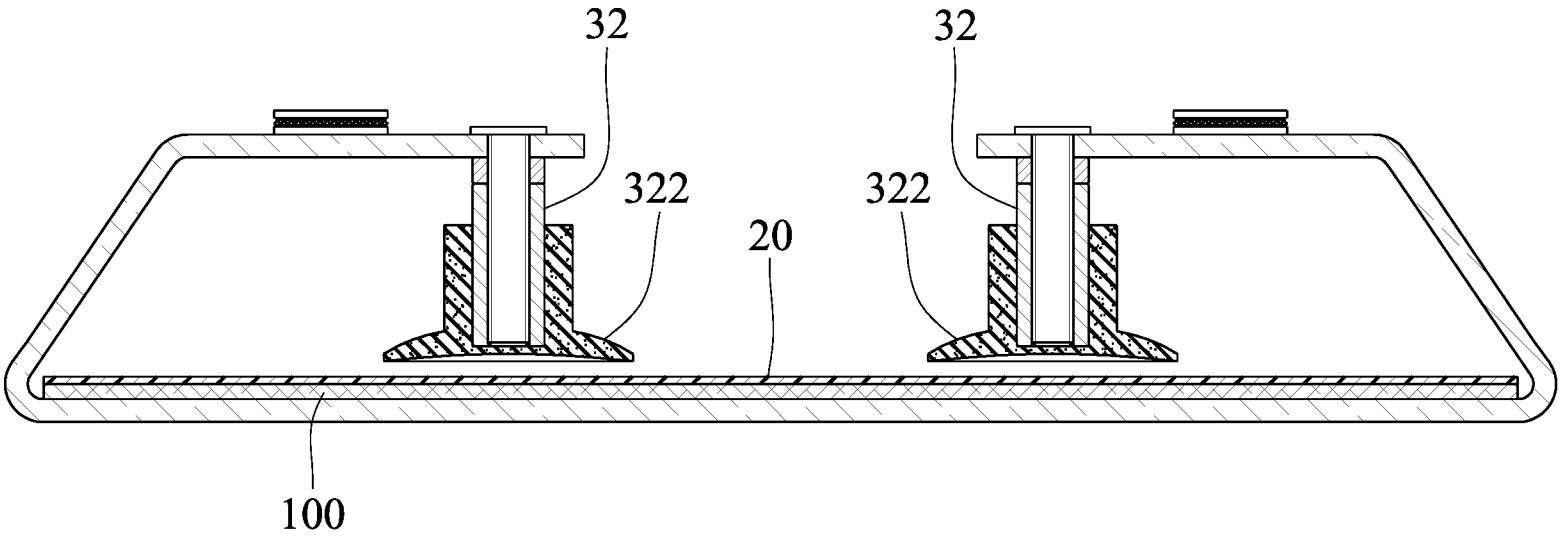
FIG. 16 is a sectional view taken along the line XVI-XVI in FIG. 15, illustrating that the first pressing portions of the first pressing unit are separated from a pressing plate of the fourth embodiment by an interval.
Figure 17:
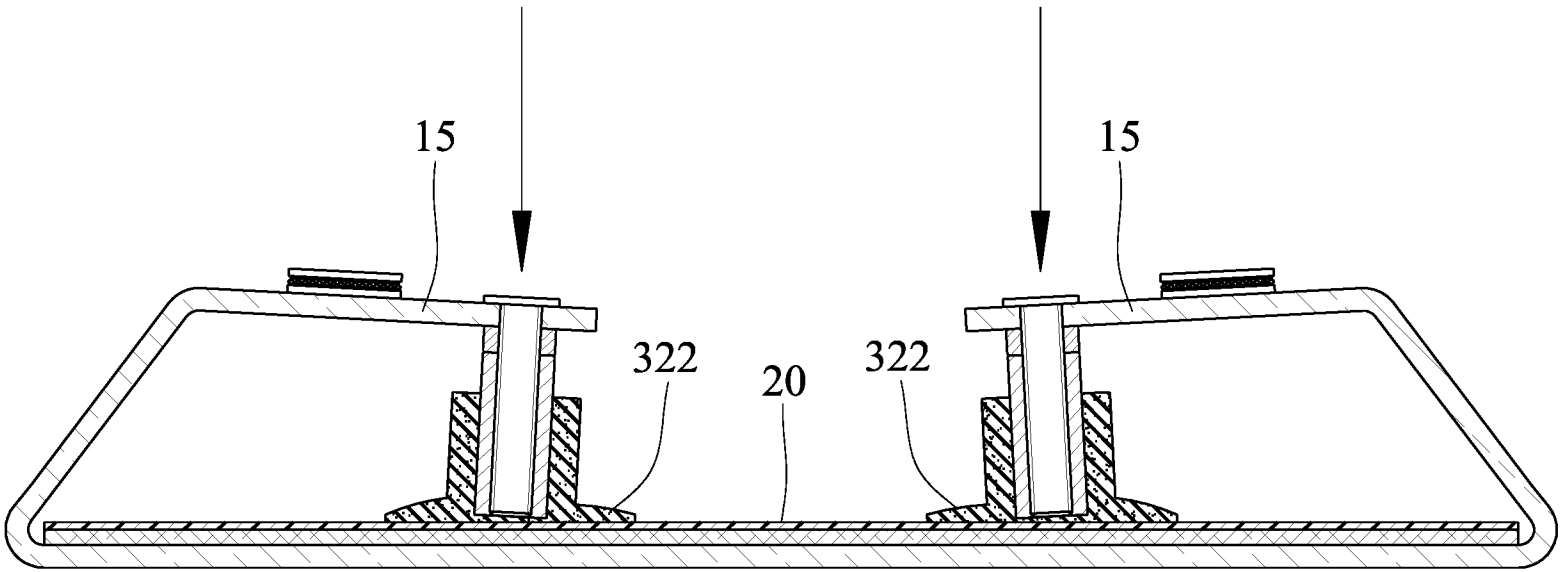
FIG. 17 is similar to FIG. 16, but illustrating that the first pressing portions of the first pressing unit are pressed downwardly to suck and attach the pressing plate.
Figure 18:
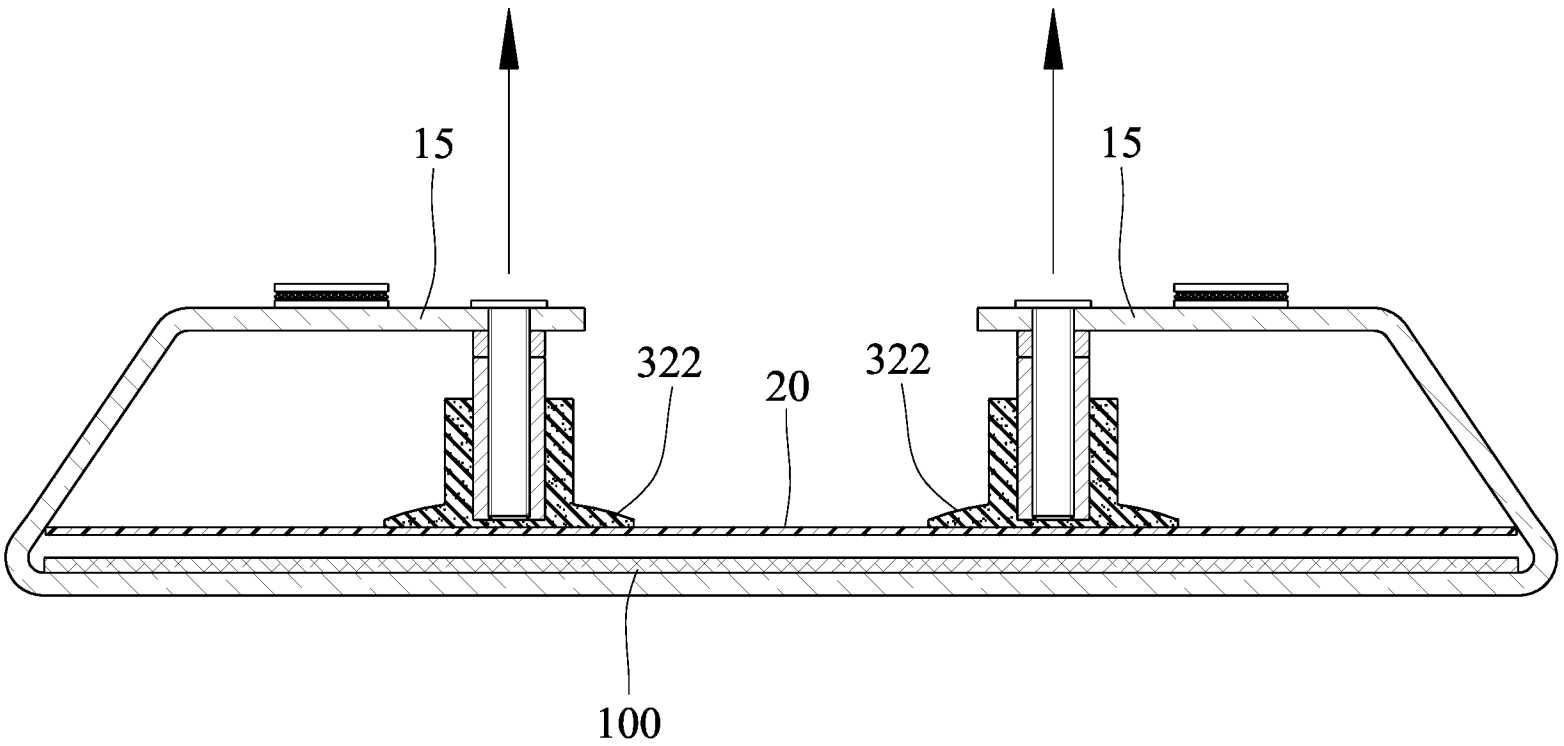
FIG. 18 is similar to FIG. 16, but illustrating that the first pressing portions of the first pressing unit lift up the pressing plate.

In addition, when the user wants to replace the picture 100, the user can alternatively push out the picture 100 in the following manner. At first, as shown in FIG. 16, the user turns and moves the first pressing portions 32 backward until the suction pads 322 are separated from the pressing plate 20, causing the suction pads 322 separated from the pressing plate 20 by an interval. After that, as shown in FIG. 17, the user presses the extending plates 15 until the suction pads 322 suck and attach the pressing plate 20. At last, as shown in FIG. 18, the user releases the extending plates 15. When the extending plates 15 move back to the original positions thereof, the extending plates 15 lift up the pressing plate 20 through the suction pads 322, causing the pressing plate 20 separated from the picture 100 by the interval. As such, it is relatively more convenient for the fingers of the user to push out the picture 100 from one side of the pressing plate 20 through the taking-out through holes 21 as shown in FIG. 15.

Therefore, this fourth embodiment can attain the same objectives and effects that the above-mentioned first embodiment can.

In conclusion, the picture frame device of the present invention is not only effective in clipping the picture firmly and tightly, but also convenient for the user to replace the picture from time to time. Further, the picture frame device of the present invention has great exhibition effect, thereby certainly attaining the objectives of the present invention.

However, the above description is only illustrative for the embodiments of the present invention, not limitative of the present invention. The simple equivalent variations and modifications according to the claims and the specification of the present invention are also included within the scope of the present invention.

What is claimed is:

1. A picture frame device comprising:

a main frame unit comprising a frame body having a front plate, two connecting plates extending respectively and backward from two opposite sides of the front plate, and two extending plates respectively extending from the connecting plates in a way that one of the extending plates extends downwardly and the other of the extending plates extends upwardly, the connecting plates being integrally connected with the front plate, the extending plates being integrally connected with the connecting plates respectively, the front plate, the connecting plates and the extending plates cooperatively defining an accommodating space, the frame body being made of a transparent plastic material;

a first pressing unit comprising a plurality of first fastening portions respectively disposed on the extending plates, and a plurality of first pressing portions respectively disposed on the first fastening portions in a way that each of the first pressing portions is moveably engaged with one of the first fastening portions and movable toward or away from the front plate; and a pressing plate detachably disposed in the accommodating space of the frame body, the first pressing portions facing toward the pressing plate;

wherein each of the first fastening portions comprises a first bolt fixedly disposed on one of the extending plates, and each of the first pressing portions comprises a first movable nut moveably and screwingly threaded onto the first bolt of one of the first fastening portions, and a suction pad disposed on the first movable nut for sucking and attaching the pressing plate.

2. The picture frame device as claimed in claim 1, wherein each of the first fastening portions further comprises a first fastening nut screwingly threaded onto the first bolt to fasten the first bolt to one of the extending plates.

3. The picture frame device as claimed in claim 2, wherein each of the connecting plates extends backward from the front plate inclinedly; an acute angle is included between each of the connecting plates and the front plate; each of the connecting plates has two connecting lateral edges inclined toward each other and connected between the front plate and one of the extending plates; distances between the connecting lateral edges of each of the connecting plates decrease gradually from the front plate backwardly.

4. The picture frame device as claimed in claim 3, wherein each of the extending plates has a plurality of hanging holes communicating with the accommodating space.

5. The picture frame device as claimed in claim 4, wherein the main frame unit further comprises an attachment combination having two first attachment members disposed to the extending plates respectively, and a second attachment member for being commonly engaged by the two first attachment members; each of the first attachment members has inner and outer surfaces provided with loops and hooks respectively; each of the first attachment members is disposed to one of the extending plates; each of the first attachment members penetrates through two adjacent said hanging holes with the loops and the hooks engaged together; the second attachment member is provided at an outer surface with loops; the first attachment members are detachably engaged with the second attachment member by a loop and hook fastening.

6. The picture frame device as claimed in claim 1, wherein the pressing plate is a light guiding unit detachably disposed in the accommodating space of the frame body and having a light guiding panel, two installation boards disposed on a backside surface of the light guiding panel and located adjacent to two opposite sides of the light guiding panel respectively, and two combining frame strips clipping the installation boards and the light guiding panel together; each of the first pressing portions faces toward one of the installation boards.

7. The picture frame device as claimed in claim 6, further comprising a second pressing unit comprising a plurality of second fastening portions disposed on the extending plates respectively, and a plurality of second pressing portions respectively disposed on the second fastening portions in a way that each of the second pressing portions is moveably engaged with one of the second fastening portions and moveable toward or away from one of the installation boards.

8. The picture frame device as claimed in claim 7, wherein each of the installation boards has a plurality of limiting grooves penetrating therethrough; each of the second fastening portions comprises a second bolt fixedly disposed on one of the extending plates; each of the second pressing portions is moveably and screwingly threaded onto the second bolt of one of the second fastening portions; each of the second pressing portions faces toward one of the limiting grooves.

* * * * *